US010393124B2

(12) United States Patent
Hölzer et al.

(10) Patent No.: US 10,393,124 B2
(45) Date of Patent: Aug. 27, 2019

(54) VACUUM-PUMP ROTOR

(71) Applicant: Leybold GmbH, Köln (DE)

(72) Inventors: Rainer Hölzer, Hürth (DE); Kai Uhlig, Dresden (DE)

(73) Assignee: LEYBOLD GMBH, Köln (DE)

( * ) Notice: Subject to any disclaimer, the term of this patent is extended or adjusted under 35 U.S.C. 154(b) by 4 days.

(21) Appl. No.: 15/568,840

(22) PCT Filed: May 25, 2016

(86) PCT No.: PCT/EP2016/061786
§ 371 (c)(1),
(2) Date: Oct. 24, 2017

(87) PCT Pub. No.: WO2016/198260
PCT Pub. Date: Dec. 15, 2016

(65) Prior Publication Data

US 2018/0100510 A1 Apr. 12, 2018

(30) Foreign Application Priority Data

Jun. 8, 2015 (DE) ..... 20 2015 004 001 U
Jun. 15, 2015 (DE) ..... 20 2015 004 160 U

(51) Int. Cl.
*F04D 19/04* (2006.01)
*F04D 29/02* (2006.01)
*F04D 29/32* (2006.01)

(52) U.S. Cl.
CPC ..... *F04D 19/042* (2013.01); *F04D 19/04* (2013.01); *F04D 29/023* (2013.01);
(Continued)

(58) Field of Classification Search
CPC .... F04D 19/042; F04D 19/044; F04D 19/046; F04D 17/168; F04D 19/04; F04D 29/324
See application file for complete search history.

(56) References Cited

U.S. PATENT DOCUMENTS 7,811,062 B1 * 10/2010 Twigg ..... F01D 5/147 416/218
8,957,552 B2 * 2/2015 Hansen ..... B29C 45/0005 310/43

(Continued)

FOREIGN PATENT DOCUMENTS

DE 1071275 B 12/1958
DE 102007006915 A1 8/2008

(Continued)

OTHER PUBLICATIONS

International Search Report dated Aug. 29, 2016 for PCT application No. PCT/EP2016061786.

*Primary Examiner* — Long T Tran
(74) *Attorney, Agent, or Firm* — Ohlandt, Greeley, Ruggiero & Perle, LLP

(57) ABSTRACT

A vacuum-pump rotor, in particular a vacuum-pump rotor for a turbomolecular pump, having a hub element for connecting to a rotor shaft or for forming a rotor shaft. A plurality of rotor blades are connected to the hub element. In order to form a vacuum-pump rotor by means of which a high tip speed can be achieved, the hub element and/or the rotor blades are produced of a plurality of material layers.

18 Claims, 1 Drawing Sheet

(52) U.S. Cl.
CPC ..... *F04D 29/322* (2013.01); *F04D 29/324* (2013.01); *F05D 2300/603* (2013.01); *F05D 2300/702* (2013.01)

(56) References Cited

U.S. PATENT DOCUMENTS

| | | | | |
|---|---|---|---|---|
| 2006/0140795 | A1* | 6/2006 | Schofield | F04D 19/046 417/423.4 |
| 2013/0045094 | A1 | 2/2013 | Giors et al. | |
| 2013/0115094 | A1* | 5/2013 | Kabasawa | F04D 19/044 416/230 |
| 2013/0224001 | A1* | 8/2013 | Shirinov | F04D 3/00 415/182.1 |
| 2014/0178204 | A1* | 6/2014 | Livingston | B29C 70/443 416/230 |
| 2014/0219805 | A1* | 8/2014 | Lamboy | F01D 5/3007 416/219 R |
| 2014/0363304 | A1 | 12/2014 | Murooka | |
| 2015/0037137 | A1* | 2/2015 | Schofield | F04D 17/168 415/90 |

FOREIGN PATENT DOCUMENTS

| | | | |
|---|---|---|---|
| DE | 112011100402 | T5 | 12/2012 |
| DE | 102013209475 | A1 | 10/2014 |
| DE | 202015004160 | U1 | 9/2016 |
| JP | 09303288 | A | 11/1997 |
| WO | 2005001294 | A1 | 1/2005 |
| WO | 2005052375 | A1 | 6/2005 |

* cited by examiner

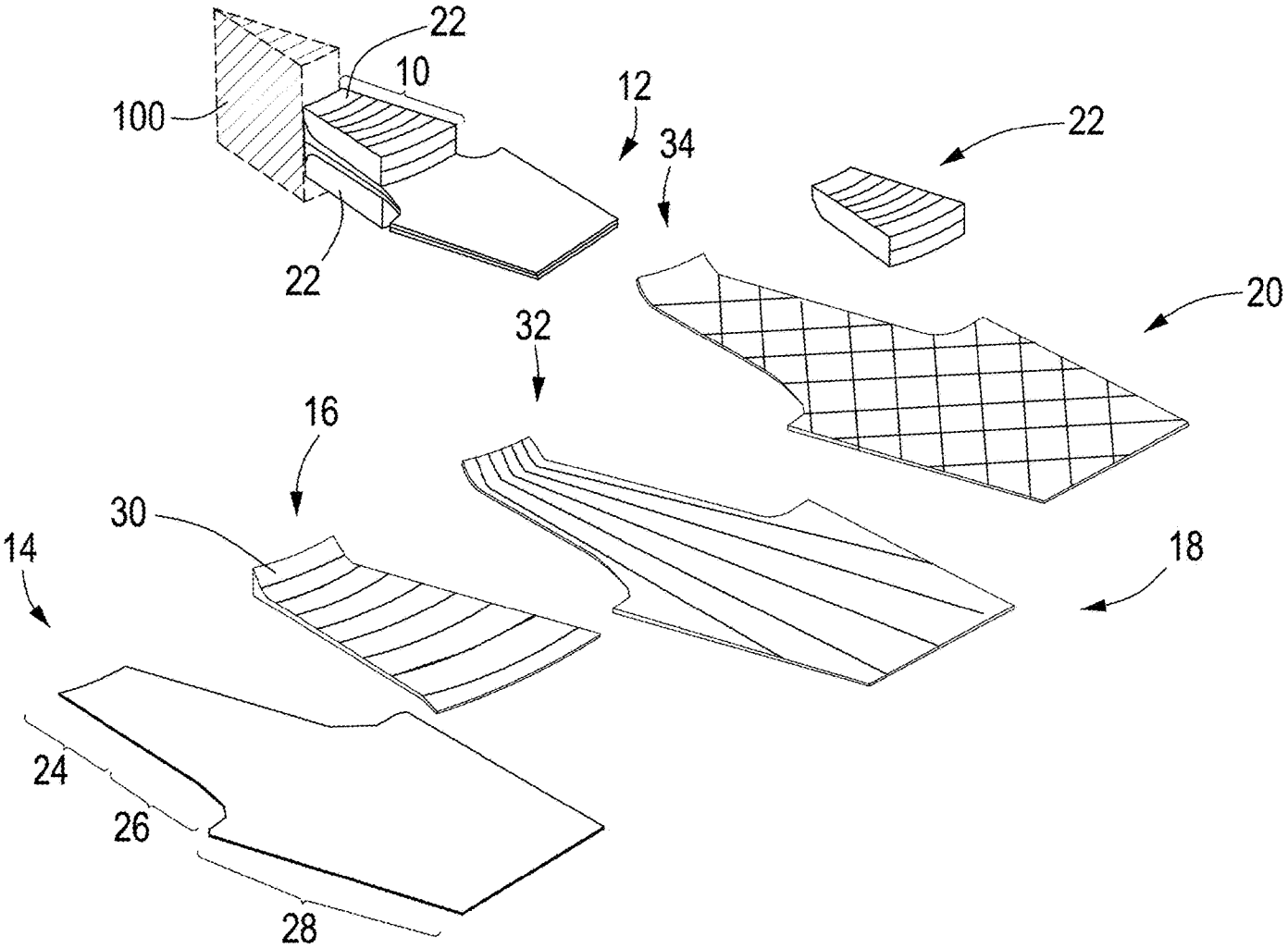
20
22
18
34
12
32
22
10
22
16
100
30
28
26
24
14

VACUUM-PUMP ROTOR

BACKGROUND

1. Field of the Disclosure

The disclosure relates to a vacuum-pump rotor, in particular a rotor for a turbomolecular vacuum pump.

2. Discussion of the Background Art

Vacuum pumps, such as e.g. turbomolecular pumps, comprise a rotor arranged on a rotor shaft. The rotor shaft is driven by an electric motor. The blades of the rotor cooperate with stator discs which usually are fixed in a pump housing. In fast-rotating rotors as used particularly in turbomolecular pumps, it is known to produce rotors from aluminum, steel or corresponding alloys. For obtaining a high vacuum of particularly less than $10^{-4}$ mbar, the rotors have to be operated at high rotational speeds. When using rotors of steel, aluminum or the like, a limiting factor resides in the tip speed of the rotor blades, i.e. the tangential speed occurring at the blade tips. With known rotors, a tip speed of 400 m/s can be obtained. A problem in this regard exists when light gases such as e.g. helium or hydrogen are to be conveyed because these have a high thermal speed and, for conveyance, will require a high rotational speed of the rotors, i.e. particularly a high tip speed.

It is an object of the disclosure to provide a vacuum-pump rotor which is adapted to reach a high tip speed.

SUMMARY

The vacuum-pump rotor of the disclosure comprises a hub element which is connectable to the shaft of the vacuum pump and/or forms said shaft.

To the hub element, rotor blades are connected, preferably at an angled orientation.

For increasing the tip speed in accordance with the disclosure, the rotor elements and/or the hub element comprise a plurality of material layers. In this manner, it is possible, for operation in heavily stressed areas, to provide different materials by arranging material layers of different materials. Herein, it is particularly preferred that at least one of the material layers comprises fiber-reinforced material. Particularly by providing at least one material layer with fiber-reinforced material, it is rendered possible to operate vacuum-pump rotors at high rotational speeds. Particularly, it is made possible thereby to achieve a tip speed of more than 400 m/s, preferably more than 500 m/s and most preferably more than 600 m/s.

The vacuum pump rotor comprises a hub element for connection to a rotor shaft, wherein the rotor shaft can also be formed by a plurality of hub elements. To the rotor element, there are connected a plurality of rotor blades surrounding the rotor element. Preferably, the rotor blades each comprise a blade foot connected to the hub element and a blade head connected to the blade foot. Preferably, the hub element comprises at least one holding element comprising fiber-reinforced material. The holding element of the hub element has a base element connected to it, said base element being directly or indirectly connected to the blade foot and respectively to the blade head of a respective rotor blade. Preferably, the connection between the holding element and the base element is provided in such a manner that these two elements partially overlap each other so that, thereby, at least two material layers are formed. In this arrangement, at least one of the two elements comprises fiber-reinforced material, wherein it is preferred that both elements comprise fiber-reinforced material. By such a design, high stress resistance of the vacuum-pump rotor and particularly a high tip speed are rendered possible.

Particularly according the preferred embodiments of the disclosure as described hereunder, vacuum-pump rotors can be produced which will endure high stresses. As a result, it is possible to produce fast-rotating vacuum-pump rotors. At the same time, it is possible to reduce the diameter of the vacuum-pump since, due to the possible increase of the rotational speed, the required tip speed of more than 400 m/s can be reached.

Preferably, the hub element comprises two mutually opposite holding elements wherein, between the two holding elements, a hub member of the base element is arranged. In so far, a three-layered structure is realized in this area wherein it is again preferred that both hub elements and/or the hub member are produced from fiber-reinforced material. Preferably, the entire base element is produced from fiber-reinforced material.

According to a further preferred embodiment, a stiffening element is provided which preferably comprises fiber-reinforced material. Preferably, the at least one stiffening element is connected to the holding element of the hub element by face-to-face contact, it being particularly preferred that the stiffening element extends into the blade foot of the respective rotor blade. Thus, the stiffening element forms a further material layer. With particular preference, two stiffening elements are provided, these being connected, on two mutually opposite sides, to the base element and particularly to the hub member of the base element. According to a particularly preferred embodiment, the base element herein is an intermediate material layer, wherein, at least in the area of the hub member, in a mutually opposite position, respectively one stiffening element is arranged which preferably extends into the blade foot and is connected to the base element, preferably by face-to-face contact. According to a preferred embodiment, two further material layers are provided by the two holding elements which themselves are arranged on the outer side of the stiffening elements and form a substantial portion of the hub element. The two holding elements are arranged opposite to each other and are directly or indirectly connected to the respective upper sides of the stiffening elements, preferably by face-to-face contact. For further enhancement of the stress resistance of the rotor blade, it is possible to provide further intermediate layers, particularly of different materials and/or with different orientation of the fibers.

Additionally, the at least one stiffening element, preferably both stiffening elements, can be provided with a fixing element on an inner side. The fixing element is preferably formed as an axially extending projection. Preferably, the projection engages behind the respective holding element in radial direction.

According to a further preferred embodiment, at least one additional blade element is provided which preferably comprises fiber-reinforced material. The at least one additional blade element is indirectly or directly connected to the holding element. Further, the additional blade element is indirectly or directly connected to the blade foot and/or the hub member of the base element. Further, the additional blade element can also be connected to the blade head, preferably by face-to-face contact. Herein, it is preferred that the additional blade element, as a further material layer, is of an areal shape.

The additional blade element is further provided, on an inner side, with a fixing element which again can extend partially axially corresponding to a projection and/or engages behind the holding element, preferably radially.

Also in this embodiment, it is preferred to provide two additional blade elements which are arranged at different sides of the base element, wherein particularly a symmetrical configuration is preferred wherein the base element constitutes the central plane.

According to a further preferred embodiment of the vacuum-pump rotor, a further material layer is provided. In this embodiment, the additional blade element is designed as an inner additional blade element, and there is provided at least one further, outer additional blade element. The latter is connected to the inner additional blade element preferably by face-to-face contact, it being particularly preferred that the outer dimensions of the two additional blade elements are identical. Optionally, however, the outer additional blade element can cover only a part of the inner additional blade element. It is also possible that the outer dimensions of the inner additional blade element are smaller than those of the outer additional blade element. For instance, the outer additional blade element can extend into the blade head and optionally can fully cover the blade head, wherein the inner additional blade element is arranged only in the area of the blade foot and/or optionally covers only parts of the blade head.

Preferably, the base element and at least one additional blade element, preferably all additional blade elements, have substantially the same outer contour, particularly a blade-shaped outer contour.

It is further preferred that, in the area of the blade foot, the at least one stiffening element is in direct face-to-face abutment on the base element and/or one of the additional blade elements and is preferably tightly connected thereto. Further, it is preferred that, in the area of the blade foot or the blade head, the inner additional blade element is in direct face-to-face abutment on the outer additional blade element and is preferably connected thereto. The individual rotor blades and also of the hub element preferably have a multi-layered configuration in such a manner that the configuration is symmetrical to the base element.

A usually ring-shaped hub element comprises rotor blades on its periphery, preferably a plurality of rotor blades, preferably pitched.

For increasing the tip speed as provided by the disclosure, the hub element and/or the rotor blades preferably comprise a fiber-reinforced material. Herein, the fibers are largely arranged in a stress-adapted manner. This has the result that the vacuum-pump rotors of the disclosure can be operated at higher rotational speeds. Particularly, it is possible thereby to reach tip speeds of more than 400 m/s, preferably more than 500 m/s and most preferably more than 600 m/s.

Preferably, the material used comprises a long-fiber-reinforced material with fiber lengths of 1 to 50 mm, or endless fibers with lengths of more than 50 mm.

The stress-adapted arrangement of the fibers is preferably realized by a suitable orientation of the fibers so that the fibers can take up the forces and moments occurring at such high speeds. A stress-adapted arrangement is also realized, optionally, by additionally varying the direction, density, stiffness and/or thickness of the used fibers in accordance with the respective operational stress. This is dependent particularly on the area of the stress on the hub element and/or on the rotor blades. Further, it is particularly preferred that, for purposes of a stress-adequate arrangement, use is made of fibers of a type specifically suited for the corresponding stress.

In the above regard, it is preferred to use metal, plastic or carbon fibers. In this regard, it is in turn preferred that, optionally, in the area of the hub element or the part of the rotor blade facing toward the hub element, use is made of metal fibers because these have a different breakage behavior.

In the hub area, it can also be provided, for stabilizing the position of the fibers or for creating a volume, that massive metal parts or plastic parts are worked into the laminate. It is further preferred that e.g. plastic, carbon and/or metal fibers are impregnated or pre-impregnated. Herein, preference is given to an impregnation with epoxy resin, phenolic resin, bismaleimides and/or thermoplastic plastics and also polyurethane. Further, it is preferred to arrange the fibers as a fabric, a spread tow, tape layers, a TFP (tailored fiber placement) in a wound or braided form and/or as a spiral mesh. Further, especially stress-adequate mixed forms of different fiber arrangements are possible and are also preferred.

In order to achieve particularly high tip speeds, it is preferred that at least 20%, preferably at least 30%, of the fibers provided in and respectively on the hub element and/or in and respectively on the rotor blades are arranged in a stress-adequate manner, i.e. particularly in the principal direction of the strain. In the blade area, the fibers extend preferably in radial direction for taking up the forces. In the hub area, it is preferred that parts of the fibers are laid exclusively in the circumferential direction while, however, other areas have differing directions to allow for strain displacement. Herein, the fiber volume portion relative to the total volume of the hub element and/or of the rotor blades is preferably larger than 50%, particularly larger than 60%.

The fibers arranged in or on the hub element are preferably oriented in the circumferential direction, i.e. in the rotational direction of the hub element. Herein, the fibers are preferably arranged in a manner allowing them to take up the forces in the circumferential direction. In this respect, related to the circumferential direction, a deviation in an angular range of ±10° to ±20° is defined in the sense that the respective fibers still extend substantially in the circumferential direction.

In or on the rotor blades, the fibers preferably extend substantially radially. In the area of the blades, the fibers have to be arranged in such a manner that the fibers will take up the forces in radial direction. Also herein, a deviation in an angular range of ±10° to ±20° is defined as relating to a fiber extending substantially radially.

Particularly in the angled area of the blade portions of the rotor blades, it is preferred to use mutually intersecting fibers so as to realize a stress-adequate arrangement of the fibers, e.g. for preventing a twisting of the blade. Herein, the fibers preferably extend in an angular range from ±30° to ±45° relative to the blade longitudinal axis and from ±70° to ±90° relative to each other. Suitable for this purpose are corresponding fiber layers such as patches or spread tows, for instance. In a transition area between hub elements and rotor blades, it is particularly preferred that fibers merge from the hub element into the rotor blades so that the connecting area between the hub element and the rotor blades is of a best stress-adequate design. Particularly in such a design, it is preferred that the hub element and the rotor blades are integrally formed as one piece. However, it is also possible to connect the rotor blades to the hub by hooking, insertion into corresponding grooves and the like provisions. Also combinations of these are possible so that blade element which first have been connected to the hub element by hooking or in another manner will then be connected to the hub element via a fiber layer in this area.

Connection of the fibers can be performed by subsequent casting, resinification or the like. It is also possible, however, for defining an exact position of the fibers, to first bond the fibers to each other. The fibers can be fixed in the required direction or be connected to each other also by stitching, knitting or the like.

Further, it is preferred that the rotor blades can have a pitch angle from 8° to 50°.

With the aid of the above described vacuum-pump rotors, it is possible particularly to achieve a high tip speed of more than 400 m/s, preferably more than 500 m/s and most preferably more than 600 m/s. This has the advantage, which is essential of the disclosure, that the rotors are also suited for conveyance of light gases such as, particularly, helium and hydrogen. This further makes it possible to realize pump rotors which, while offering high conveying capacities, have reduced diameters.

It is particularly preferred that one of the additional blade elements, preferably both the inner and the outer additional blade elements, comprise a radial layer of a fiber-reinforced material, particularly fiber-reinforced plastic. Further, it is preferred that one of the additional blade elements, preferably the two outer additional blade elements, comprise a spread tow fabric layer.

Preferably, also the at least one stiffening element comprises fiber material, preferably plastic fiber material. Herein, a part of the fibers preferably extends in the circumferential direction. Thereby, a tangential layer is formed. It is preferred that also the at the least one holding element comprises fibers extending in the circumferential direction, thus forming further tangential layers. According to a preferred embodiment, particularly the inner additional blade elements comprise, with regard to a main fiber direction, radially extending fibers so that radial layers are formed. In the preferably two outer additional blade elements, the fibers are arranged in a mutually intersecting configuration, and there is preferably provided a spread tow fabric.

Particularly by the multi-layered design of the vacuum-pump rotor made from preferably different material layers with particularly preferred different orientations of the material fibers, it is rendered possible to provide vacuum-pump rotors which endure extremely high stresses so that very high tip speeds can be achieved.

According to the disclosure, the above described design of vacuum-pump rotors is preferred also for other fast-rotating rotors as used in the fields of blowers, ventilators, gas conveyance, wherein this constitutes an independent disclosure.

The disclosure will be explained in greater detail hereunder by way of a preferred embodiment with reference to the accompanying drawing.

BRIEF DESCRIPTION OF THE DRAWINGS

The FIGURE shows partial view of a vacuum-pump rotor in the assembled state and partially in exploded view, wherein the representation is simplified toward a more schematic rendering.

DETAILED DESCRIPTION OF THE PREFERRED EMBODIMENT

In the FIGURE, there is first shown a part of a multi-layered vacuum-pump rotor comprising material layers connected to each other. Here, a part of a hub element 10 is illustrated. Of the circular-ring-shaped hub element 10, only one circular-ring segment is shown here. The hub element 10 surrounds e.g. a rotor shaft 100 to which it is fixedly connected. Normally, a plurality of such ring-shaped hub elements are serially arranged in axial direction so that a plurality of vacuum-pump stages are assembled and form e.g. a rotor for a turbomolecular pump. Thereby, the individual hub elements can be connected to a rotor shaft 100 or themselves can form the rotor shaft 100 by being connected to each other in a corresponding manner. The hub element 10 has rotor blades 12 connected to it, each of them extending radially in the circumferential direction and being pitched, wherein, for clearer illustration, only one such rotor blade 12 is shown.

For better visualization of the multi-layered configuration, the drawing further includes an exploded view of the individual layers. As a medium layer in this exploded representation, a base element 14 is shown. The configuration of the entire vacuum-pump rotor in the illustrated preferred embodiment is symmetrical to base element 14. On base element 14, a stiffening element 16 is arranged wherein, in symmetry to base element 14, a further stiffening element is arranged on the opposite side in symmetry to the illustrated stiffening element 16. This holds true, in a corresponding manner, also for the next layer which is formed by an inner additional blade element 18, wherein the second additional blade element 18 itself is provided on the opposite side in symmetry to base element 14. Correspondingly, also two outer additional blade elements 20 are provided and again are arranged in symmetry to base element 14. As further elements, two holding elements 22 are provided which again are arranged symmetrically to base element 14. Herein, the holding elements 22 are the essential elements of hub element 10.

In the illustrated preferred embodiment, the base element 14 which forms the plane of symmetry has an outer contour corresponding to the outer contour of blade 12. Herein, base element 14 comprises a hub member 24 which extends into hub element 10 and respectively is arranged between the two holding elements 22 of hub element 10. In this regard, it is to be considered that the two holding elements 22 are preferably designed in ring shapes wherein, between these two ring-shaped holding elements 22, a plurality of hub members are arranged corresponding in number to the rotor blades 12. To hub member 24, a blade foot 26 is connected, preferably integrally in one piece. Said blade foot 26 represents the connection element between the hub member and a blade head 28. Herein, said blade head 28 is the essential component of rotor blade 12. The base element 14 is preferably of a one-pieced design and, according to a preferred embodiment, comprises a carbon-fiber nonwoven.

The next layer is formed by the two mutually opposite stiffening elements 16. In the illustrated exemplary embodiment, the outer contour of the stiffening elements 16 corresponds to the outer contour of hub member 24 and blade foot 26. Optionally, stiffening element 16 extends only into a part of blade foot 26. The stiffening elements comprise, on an inner side, a fixing element. This fixing element extends axially outward and engages behind each of the two holding elements 22. The stiffening element 16 is preferably designed as a tangential layer and, in so far, comprises a plurality of fibers adapted to take up tangential forces in the circumferential direction. In this design, the thickness gradient in the inner area of the hub is high.

The next material layer is formed by the two inner additional blade elements 18. The outer contour of the inner additional blade elements corresponds to the outer contour of the base element. The inner additional blade elements 18 again comprise a fixing element 32 engaging radially behind the holding elements 22 in correspondence to the fixing element 32. Preferably, the material fibers of the inner additional blade elements 18 are oriented radially so that these layers can be conceived of as radial layers.

The next material layers are formed by the outer additional blade elements 20. The outer contour of the outer additional blade elements 20 again corresponds to the outer contour of base element 14. Further, also the outer additional blade elements 20 comprise a fixing element 34 which again engages radially behind the two holding elements 22. It is preferred that the outer additional blade elements 20 are made of a spread tow fabric.

The outer material layer is formed by the two holding elements 22 wherein these do not extend into the rotor blade 12 but substantially form the hub element. Also the holding elements 22 preferably comprise material fibers, preferably plastic fibers or carbon fibers.

Of essence for the disclosure is the multi-layered configuration of the vacuum-pump rotor. In this regard, the design and the respective materials of the individual layers are preferably selected under the aspect of an optimum stress-adapted choice of materials and a fiber layout adapted to the operational requirements. Thereby, vacuum-pump rotors can be produced which endure extremely high stresses and can realize a tip speed of more than 400 m/s, preferably more than 500 m/s and most preferably more than 600 m/s.

The invention claimed is:

1. A vacuum-pump rotor comprising:

a hub element for connecting to a rotor shaft and/or for forming a rotor shaft, wherein the hub element comprises a holding element comprising fiber-reinforced material, a plurality of rotor blades radially extending from the hub element at a blade foot, and a stiffening element of a fiber-reinforced material, said stiffening element being connected to the holding element by face-to-face contact and extending into the blade foot, wherein the hub element and/or the rotor blades comprise a plurality of material layers.

2. The vacuum-pump rotor according to claim 1, wherein at least one of the material layers comprises fiber-reinforced material.

3. The vacuum-pump rotor according to claim 1, wherein the plurality of rotor blades surround the hub element, each of rotor blade of said plurality of rotor blades comprising the blade foot connected to the hub element and a blade head connected to the blade foot.

4. The vacuum-pump rotor according to claim 1, further comprising a base element comprising fiber-reinforced material said base element being directly or indirectly connected to the holding element.

5. The vacuum-pump rotor according to claim 4, wherein the base element comprises a hub member arranged in the hub element and forms the blade foot.

6. The vacuum-pump rotor according to claim 1, wherein the hub element comprises two mutually opposite holding elements having arranged between them a hub member of the base element.

7. The vacuum-pump rotor according to claim 1, wherein the stiffening element comprises, on an inner side, a fixing element extending at least partially axially and/or engaging behind the holding element.

8. The vacuum-pump rotor according to claim 1, wherein two mutually opposite stiffening elements are arranged on different sides of the base element.

9. The vacuum-pump rotor according to claim 1, wherein at least one additional blade element is provided which comprises fiber-reinforced material, said additional blade element being connected to the holding element and extending into the blade foot and into the blade head.

10. The vacuum-pump rotor according to claim 9, wherein the at least one additional blade element comprises, on an inner side, a fixing element extending at least partially axially and/or engaging behind the holding element.

11. The vacuum-pump rotor according to claim 9, wherein one of the additional blade elements comprises a radial layer of fiber-reinforced material.

12. The vacuum-pump rotor according to claim 11, wherein at least one of the additional blade elements is an inner additional blade element connected to a blade head of the base element by face-to-face contact.

13. The vacuum-pump rotor according to claim 12, wherein, in the area of the blade foot and/or the blade head, the inner additional blade element is in direct abutment on the outer additional blade element by face-to-face contact.

14. The vacuum-pump rotor according to claim 9, wherein one of the additional blade elements comprises a spread tow fabric layer.

15. The vacuum-pump rotor according to claim 14, wherein at least one of the additional blade elements is designed as an outer additional blade element connected to the inner additional blade element by face-to-face contact.

16. The vacuum-pump rotor according to claim 1, wherein the base element and at least one additional blade element has substantially the same outer contour.

17. The vacuum-pump rotor according to claim 1, wherein, in the area of the blade foot, the stiffening element is in direct face-to-face abutment on the base element and/or one of the additional blade elements.

18. The vacuum-pump rotor according to claim 1, wherein the rotor is symmetrical multi-layered relative to the base element.

* * * * *